US008541152B2

(12) United States Patent
Koyama

(10) Patent No.: US 8,541,152 B2
(45) Date of Patent: Sep. 24, 2013

(54) MAGNETIC TONER FOR SINGLE COMPONENT DEVELOPER

(75) Inventor: Akinori Koyama, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 13/432,669

(22) Filed: Mar. 28, 2012

(65) Prior Publication Data

US 2012/0258394 A1 Oct. 11, 2012

(30) Foreign Application Priority Data

Apr. 6, 2011 (JP) ..... 2011-084828

(51) Int. Cl.
*G03G 9/083* (2006.01)
*G03G 9/097* (2006.01)

(52) U.S. Cl.
USPC ..... 430/106.1; 430/108.21

(58) Field of Classification Search
USPC ..... 430/106.1, 106.2, 106.3, 108.21
See application file for complete search history.

(56) References Cited

FOREIGN PATENT DOCUMENTS

| | | | |
|---|---|---|---|
| JP | 2-135368 | A | 5/1990 |
| JP | 2003-050481 | A1 * | 2/2003 |

OTHER PUBLICATIONS

The AIPN Japanese Patent Office machine-assisted translation of JP 2003-050481 (pub. Feb. 2003).*

* cited by examiner

*Primary Examiner* — Janis L Dote

(57) ABSTRACT

A magnetic toner for a single component developer includes in a polyester resin at least a nigrosine dye that is immiscible with the polyester resin, a nigrosine dye that is miscible with the polyester resin, and a magnetic powder. The nigrosine dye that is immiscible with the polyester resin has an average diameter of 0.2 to 4 μm when dispersed in the polyester resin.

4 Claims, No Drawings

MAGNETIC TONER FOR SINGLE COMPONENT DEVELOPER

This application is based on and claims the benefit of priority from Japanese Patent Application No. 2011-084828, filed on 6 Apr. 2011, the content of which is incorporated herein by reference.

BACKGROUND

The present disclosure relates to a magnetic toner for a single component developer.

In electrophotography and the like, in general, a photoconductor obtained by charging with corona charge etc., on a latent image carrier constituted with a photoelectric conductive photoconductor or the like is exposed with laser, LED etc., to form an electrostatic latent image, which is then visualized through developing by a developer such as a toner to obtain an image with high quality. The toners which may be employed in such a development process are usually provided by: mixing a thermoplastic resin as a binder with a colorant, a charge control agent, a release agent, etc.; kneading the mixture; pulverizing and classifying to give toner particles having an average particle diameter of 5 to 10 μm. Furthermore, in order to impart flowability to the toner, to control charge of the toner, and to improve easiness of cleaning of the toner remaining on the photoconductor without being transferred to a recording medium, in general, inorganic or inorganic metal fine powder such as silica or titanium oxide is added to the toner.

At present, known dry development processes in a variety of electrostatography systems which have been put into practical applications include a 2 component development system in which a toner and a carrier such as an iron powder are used, and a magnetic single component development system in which a toner containing a magnetic powder in the toner is used without using a carrier.

Toners containing a magnetic powder for use in magnetic single component development systems (hereinafter, also referred to as magnetic toners) are advantageous in low cost and superior durability; however, they are disadvantageous in that formation of an image having a desired image density is difficult due to lower coloring strength of the magnetic powder as compared with colorants such as carbon black.

In order to overcome such disadvantages in connection with magnetic toners, for example, a positively chargeable magnetic toner which may be used as a single component developer has been provided containing a binder resin and a magnetic powder as principal components, to which a quaternary ammonium salt, a fatty acid metal salt having a metal content of no less than 2.0% by weight and a melting point of 110° C. to 145° C., and a nigrosine dye were added.

However, according to the magnetic toner for a single component developer including a nigrosine dye as the toner described above, favorable charging property is less likely to be achieved when a nigrosine dye is dispersed in a binder resin in a state miscible with the binder resin, and thus formation of favorable image can be difficult. On the other hand, when a nigrosine dye is aggregated and dispersed in a binder resin, due to failure in sufficient coloring of the binder resin with the nigrosine dye, and inferior coloring strength of the magnetic powder, an image having a desired image density is less likely to be obtained.

Also, due to superior fixativity, and ease in homogenous dispersion in the binder resin of the components included in the toner, a polyester resin is often used as the binder resin. However, in magnetic toners contains a polyester resin as a binder resin and a nigrosine dye, the nigrosine dye is aggregated and dispersed in a binder resin, whereby positively chargeable sites are likely to be formed on the surface of the toner. In this case, since the polyester resin is negatively chargeable, the toner particles are likely to be electrically aggregated with one another in low-temperature and low-humidity environments. Therefore, disturbance (layer disturbance) of the thickness of a toner thin layer formed on a developing sleeve is likely to occur in low-temperature and low-humidity environments according to such a toner, leading to a problem of poor image being likely to be generated accompanying with the layer disturbance.

The present disclosure was made in view of the foregoing circumstances, and an object of the present disclosure is to provide a magnetic toner for single component developer that is capable of forming an image having a desired image density, and capable of inhibiting occurrence of layer disturbance in low-temperature and low-humidity environments.

SUMMARY

The present disclosure relates to a magnetic toner for a single component developer, the magnetic toner including in a polyester resin at least a nigrosine dye that is immiscible with the polyester resin, a nigrosine dye that is miscible with the polyester resin, and a magnetic powder. The nigrosine dye that is immiscible with the polyester resin having an average diameter when dispersed in the polyester resin of 0.2 to 4 μm.

DETAILED DESCRIPTION

The present disclosure is explained in detail with respect to embodiments below; however, the present disclosure is not in any way limited to the embodiments below and may be carried out with appropriate modification within the object of the present disclosure. In addition, although explanation may be occasionally omitted with respect to overlapping matters, this does not limit the gist of the present disclosure.

The magnetic toner for a single component developer of the present disclosure includes a polyester resin as a binder resin, includes in the polyester resin at least a nigrosine dye that is immiscible with the polyester resin, a nigrosine dye that is miscible with the polyester resin and a magnetic powder, and further includes in the polyester resin as desired optional components such as a release agent, a colorant other than the nigrosine dye and a charge control agent other than the nigrosine dye. Also, the toner of the present disclosure may include an external additive attached to the surface thereof. Hereinafter, essential or optional components of the magnetic toner for a single component developer of the present disclosure, i.e., a binder resin, a nigrosine dye, a magnetic powder, a release agent, a colorant other than the nigrosine dye, a charge control agent other than the nigrosine dye, and an external additive, as well as a method for producing a magnetic toner for a single component developer are explained in this order.

Binder Resin

The magnetic toner for a single component developer of the present disclosure includes a polyester resin as a binder resin. When a polyester resin is used as a binder resin in the toner, components included in the toner are likely to be homogenously dispersed in the binder resin. In addition, when a polyester resin is used as a binder resin, a toner that is superior in charging property, and fixativity on the paper is likely to be obtained. As the polyester resin, those obtained by condensation polymerization or cocondensation polymerization of an alcohol component and a carboxylic acid component may be used. The components which may be used in synthesizing the polyester resin are exemplified by the following alcohol components and carboxylic acid components.

A bivalent, trivalent or higher-valent alcohol may be used as the alcohol component. Specific examples of the bivalent, trivalent or higher-valent alcohols include diols such as ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexane dimethanol, dipropylene glycol, polyethylene glycol, polypropylene glycol, and polytetramethylene glycol; bisphenols such as bisphenol A, hydrogenated bisphenol A, polyoxyethylenated bisphenol A, and polyoxypropylenated bisphenol A; and trivalent or higher-valent alcohols such as sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Bivalent, trivalent or higher-valent carboxylic acids may be used as the carboxylic acid component. Specific examples of the bivalent, trivalent or higher-valent carboxylic acids include bivalent carboxylic acids such as maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, and malonic acid, or alkyl or alkenyl succinic acids including n-butyl succinic acid, n-butenyl succinic acid, isobutylsuccinic acid, isobutenylsuccinic acid, n-octylsuccinic acid, n-octenylsuccinic acid, n-dodecylsuccinic acid, n-dodecenylsuccinic acid, isododecylsuccinic acid, isododecenylsuccinic acid; and trivalent or higher-valent carboxylic acids such as 1,2,4-benzenetricarboxylic acid (i.e., trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl) methane, 1,2,7,8-octanetetracarboxylic acid, pyromellitic acid, and Enpol trimer acid, and the like. The bivalent, trivalent or higher-valent carboxylic acids may be used as ester-forming derivatives such as acid halides, acid anhydrides, and lower alkyl esters. The term "lower alkyl" means an alkyl group having 1 to 6 carbon atoms.

The softening temperature of the polyester resin is preferably 80° C. to 150° C., and more preferably 90° C. to 140° C.

Nigrosine Dye

The magnetic toner for a single component developer of the present disclosure essentially contains a nigrosine dye for the purpose of coloring of the toner, and adjusting the charged amount of the toner. The type of the nigrosine dye included in the toner is not particularly limited, provided that it falls within a range that does not inhibit the object of the present disclosure, and for example, nigrosine or a nigrosine compound such as a nigrosine salt or a nigrosine derivative, or an acidic dye constituted with a nigrosine compound such as nigrosine BK, nigrosine NB or nigrosine Z may be used.

When a nigrosine dye is synthesized, the synthesis method is not particularly limited. A nigrosine dye may be produced by, for example, heating aniline or an aniline compound such as aniline hydrochloride, and nitrobenzene or a nitrobenzene compound such as nitrophenol or nitrocresol in the presence of a mixture of hydrochloric acid and iron or iron chloride, or iron chloride and the like to permit condensation.

In the present disclosure, a nigrosine dye that is immiscible with the polyester resin included as a binder resin, and a nigrosine dye that is miscible with the polyester resin are used in combination. Discrimination as to whether or not the nigrosine dye is miscible with the polyester resin can be made by observing the state of dispersion of the nigrosine dye in a polyester resin used as a binder resin with a transmission electron microscope (TEM) according to the following method. Method for Determining Miscibility of Nigrosine Dye 3 parts by mass of a nigrosine dye are added to 100 parts by mass of a polyester resin, and the polyester resin and the nigrosine dye are mixed by stirring using a mixer such as a HENSCHEL mixer. The mixture thus obtained is melted and kneaded by a twin screw extruder at a cylinder temperature preset to fall within the range of from a temperature lower than the melting point of the polyester resin by 40° C. to the melting point of the polyester resin. As a sample for determining the miscibility, a thin piece of the melted and kneaded product having a thickness 200 nm is prepared with an ultramicrotome. After the sample thus obtained is subjected to vapor deposition with carbon, the sample is observed with a transmission electron microscope at a magnification of ×3,000 to ×30,000 to visually determine the presence/absence of dispersion particles of the nigrosine dye in the polyester resin. In the case in which dispersion particles of the nigrosine dye are observed, the nigrosine dye used is determined as being immiscible with the polyester resin, whereas in the case in which dispersion particles of the nigrosine dye are not observed, the nigrosine dye used is determined as being miscible with the polyester resin.

The apparatus used in the foregoing method for determining the miscibility of a nigrosine dye is not particularly limited as long as predetermined steps can be carried out. For example, as the twin screw extruder, TEM-26SS (manufactured by Toshiba Machine Co., Ltd.) may be used, and as the ultramicrotome, for example, EM UC6 (manufactured by Leica) may be used. As the transmission electron microscope, for example, JSM-7600F (manufactured by Jeol Ltd.) may be used.

When the polyester resin and the nigrosine dye are melted and kneaded under the aforementioned temperature conditions, the polyester resin and the nigrosine dye that is miscible with the polyester resin can be sufficiently kneaded; therefore, as long as the nigrosine dye is miscible with the polyester resin, homogenous dispersion in the polyester resin is enabled to the extent that particles of the nigrosine dye cannot be observed with TEM at the magnification of from ×3,000 to ×30,000.

Additionally, according to the toner of the present disclosure, the nigrosine dye that is immiscible with the polyester resin and dispersed in the polyester resin has an average diameter of 0.2 to 4 μm in the polyester resin that is a binder resin. Due to the nigrosine dye that is immiscible with the polyester resin dispersed in the polyester resin having an average diameter falling within such a range in the binder resin, a toner capable of forming an image having a desired image density is likely to be obtained. The average diameter of the nigrosine dye dispersed in the toner can be determined according to the following method.

Method for Determining the Average Diameter of Nigrosine Dye Dispersed in Toner

A toner containing a nigrosine dye is embedded in a resin such as Technovit 2000LC (manufactured by Maruto Instrument Co., Ltd.). A thin piece having a thickness of 200 nm is prepared from a resin block including the toner as a sample for electron microscopic observation with an ultramicrotome (EM UC6, manufactured by Leica). After the resulting sample is subjected to vapor deposition with carbon, the sample is observed with a transmission electron microscope at a magnification of from ×3,000 to ×30,000. The image obtained by the observation with the transmission electron microscope is analyzed using image analysis software such as WINROOF (manufactured by Mitani Corporation), whereby the average diameter of the nigrosine dye dispersed in the binder resin of the toner is determined. It should be noted that the nigrosine dye and the magnetic powder can be distinguished on a transmission electron photomicrograph. Also, even if the toner contains in addition to the nigrosine dyes and the magnetic powder, a substance having a particulate form, the type of the particles observed can be distinguished according to a procedure such as EDX (Energy Dispersive X-ray spectroscopy).

The average diameter of a dispersed nigrosine dye usually varies depending on the molecular weight of the nigrosine dye, and a nigrosine dye having a greater molecular weight has a greater average diameter of the nigrosine dye dispersed in the toner. Therefore, adjusting the molecular weight of the nigrosine dye enables the average diameter of a dispersed nigrosine dye to be adjusted. Although the method for adjusting the molecular weight of the nigrosine dye is not particularly limited, for example, the molecular weight may increase by elongating the reaction time period for synthesis of the nigrosine dye. Specifically, when the nigrosine dye is to be synthesized by adding a nitrobenzene compound in small aliquots to an aniline compound heated, the molecular weight of the resulting nigrosine dye can be adjusted by regulating the time period of addition of nitrobenzene.

The nigrosine dye that is immiscible with the polyester resin preferably has a weight average molecular weight of 305 to 535 as determined on gel permeation chromatography. When the nigrosine dye that is immiscible with the polyester resin has a weight average molecular weight falling within such a range, the average diameter of the nigrosine dye dispersed in the polyester resin can be readily adjusted to fall within a desired range.

Also, the nigrosine dye that is miscible with the polyester resin preferably has a weight average molecular weight of no greater than 212 as determined on gel permeation chromatography. When the nigrosine dye that is miscible with the polyester resin has a weight average molecular weight falling within such a range, the nigrosine dye that is miscible with the polyester resin is likely to be favorably dispersed in the polyester resin, and thus a toner capable of forming an image having a desired image density is likely to be obtained.

The amount of the nigrosine dye that is immiscible with the polyester resin used, and the amount of the nigrosine dye that is miscible with the polyester resin used are not particularly limited, provided that they fall within a range that does not inhibit the object of the present disclosure. Typically, the amount of the nigrosine dye that is immiscible with the polyester resin used is preferably 0.1 to 10 parts by mass, and more preferably 1 to 5 parts by mass with respect to 100 parts by mass of the binder resin (the polyester resin), whereas the amount of the nigrosine dye that is miscible with the polyester resin used is preferably 0.1 to 5 parts by mass, and more preferably 0.5 to 2 parts by mass with respect to 100 parts by mass of the binder resin (the polyester resin).

The ratio of the amount of the nigrosine dye that is immiscible with the polyester resin used, to the amount of the nigrosine dye that is miscible with the polyester resin used is not particularly limited, provided that it falls within a range that does not inhibit the object of the present disclosure. Typically, the amount of the nigrosine dye that is miscible with the polyester resin used is preferably 1 to 300 parts by mass, and more preferably 10 to 100 parts by mass with respect to 100 parts by mass of the nigrosine dye that is immiscible with the polyester resin.

Magnetic Powder

Since the magnetic toner for a single component developer of the present disclosure is a magnetic toner, it essentially contains a magnetic powder in a binder resin. The type of the magnetic powder included in the binder resin is not particularly limited, provided that it falls within a range that does not inhibit the object of the present disclosure. Examples of suitable magnetic powder include iron material such as ferrite and magnetite; ferromagnetic metals such as cobalt, nickel; alloys including iron, and/or a ferromagnetic metal; compounds including iron, and/or a ferromagnetic metal; ferromagnetic alloys which have been subjected to a ferromagnetizing treatment such as a heat treatment; and chromium dioxide.

The particle diameter of the magnetic powder is not limited, provided that it falls within a range that does not inhibit the object of the present disclosure. Specific particle diameter of the magnetic powder is preferably 0.1 to 1.0 μm, and more preferably 0.1 to 0.5 μm. When the magnetic powder having a particle diameter falling within such a range is used, the magnetic powder is likely to be homogenously dispersed in the binder resin.

The magnetic powder used may be one which had been subjected to a surface treatment with a surface treatment agent such as a titanium based coupling agent or a silane based coupling agent for the purpose of improving dispersibility in the binder resin, and the like.

The amount of the magnetic powder used is not particularly limited, provided that it falls within a range that does not inhibit the object of the present disclosure. Specific amount of the magnetic powder used is preferably 35 to 60 parts by mass, and more preferably 40 to 60 parts by mass with respect to 100 parts by mass of the entire amount of the toner. When the amount of the magnetic powder used is excessive, image density is likely to be reduced when printing is carried out over a long period of time, and/or fixativity may be significantly deteriorated. When the amount of the magnetic powder used is too small, fogging is likely to be generated when forming an image, and the image density is likely to be reduced when printing is carried out over a long period of time.

Release Agent

The magnetic toner for a single component developer may contain a release agent for the purpose of improving fixability and anti-offset property. The type of the release agent added to the toner is not particularly limited, provided that it falls within a range that does not inhibit the object of the present disclosure. The release agent is preferably a wax; and examples of the wax include polyethylene wax, polypropylene wax, fluorine resin wax, Fischer-Tropsch wax, paraffin wax, ester wax, Montan wax, rice wax, and the like. These waxes may be used in a combination of two or more. Generation of offset or image smearing (stain around images generating upon rubbing the images) may be effectively inhibited by adding the release agent to the toner.

The amount of the release agent used is not particularly limited, provided that it falls within a range that does not inhibit the object of the present disclosure. Specific amount of the release agent used is preferably 1 to 5 parts by mass with respect to 100 parts by mass of the binder resin. When the amount of the release agent used is too small, the desired effect may not be achieved for inhibiting the generation of offset or image smearing. Whereas, when the amount of the release agent used is excessive, storage stability may be deteriorated due to fusion of the toner itself.

Charge Control Agent

In order to adjust the charging property of the toner, the magnetic toner for a single component developer of the present disclosure may include a positively chargeable charge control agent other than the nigrosine dye, provided that it falls within a range that does not inhibit the object of the present disclosure.

Specific examples of the positively chargeable charge control agent which may be used together with the nigrosine dye include azine compounds such as pyridazine, pyrimidine, pyrazine, ortho-oxazine, meta-oxazine, para-oxazine, ortho-thiazine, meta-thiazine, para-thiazine, 1,2,3-triazine, 1,2,4-triazine, 1,3,5-triazine, 1,2,4-oxadiazine, 1,3,4-oxadiazine, 1,2,6-oxadiazine, 1,3,4-thiadiazine, 1,3,5-thiadiazine, 1,2,3,4-tetrazine, 1,2,4,5-tetrazine, 1,2,3,5-tetrazine, 1,2,4,6-oxatriazine, 1,3,4,5-oxatriazine, phthalazine, quinazoline, and quinoxaline; direct dyes constituted with an azine compounds such as azine FastRed FC, azine FastRed 12BK, azine Violet BO, azine Brown 3G, azine Light Brown GR, azine Dark Green BH/C, azine Deep Black EW, and azine Deep Black 3RL; metal salts of naphthenic acid or a higher fatty acid; alkoxylated amine; alkylamide; quaternary ammonium salts such as benzylmethylhexyldecyl ammonium, and decyltrimethylammonium chloride; and the like.

A resin having a quaternary ammonium salt, a carboxylic acid salt, or carboxyl group as a functional group may be also used as a positively chargeable charge control agent together with the nigrosine dye. More specifically, one, or two or more of a styrene resin having a quaternary ammonium salt, an acrylic resin having a quaternary ammonium salt, a styrene-acrylic resin having a quaternary ammonium salt, a polyester resin having a quaternary ammonium salt, a styrene resin having a carboxylic acid salt, an acrylic resin having a carboxylic acid salt, a styrene-acrylic resin having a carboxylic acid salt, a polyester resin having a carboxylic acid salt, a styrene resin having a carboxyl group, an acrylic resin having a carboxyl group, a styrene-acrylic resin having a carboxyl group, a polyester resin having a carboxyl group and the like may be exemplified. The molecular weight of these resins is not particularly limited, provided that it falls within a range that does not inhibit the object of the present disclosure; and either an oligomer or a polymer may be included.

Among the resins which may be used as the positively chargeable charge control agent, styrene-acrylic copolymer resins having a quaternary ammonium salt as a functional group are more preferred in light of possibility of easy regulation of the charged amount of the toner to fall within a desired range. In a styrene-acrylic copolymer resin having a quaternary ammonium salt as a functional group, specific examples of preferable acrylic comonomer to be copolymerized with a styrene unit include (meth)acrylic acid alkyl esters such as methyl acrylate, ethyl acrylate, n-propyl acrylate, iso-propyl acrylate, n-butyl acrylate, iso-butyl acrylate, 2-ethylhexyl acrylate, methyl methacrylate, ethyl methacrylate, n-butyl methacrylate and iso-butyl methacrylate.

In addition, as the quaternary ammonium salt, a unit derived from dialkylaminoalkyl(meth)acrylate, dialkyl (meth)acrylamide, or dialkylaminoalkyl(meth)acrylamide via a step of quaternization. Specific examples of the dialkylaminoalkyl(meth)acrylate include dimethylaminoethyl (meth)acrylate, diethylaminoethyl(meth)acrylate, dipropylaminoethyl(meth)acrylate, dibutylaminoethyl(meth) acrylate and the like; specific examples of the dialkyl(meth) acrylamide include dimethyl methacrylamide; and specific examples of the dialkylaminoalkyl(meth)acrylamide include dimethylaminopropyl methacrylamide. In addition, a hydroxyl group-containing polymerizable monomer such as hydroxyethyl(meth)acrylate, hydroxypropyl(meth)acrylate, 2-hydroxybutyl(meth)acrylate or N-methylol (meth)acrylamide may be used in combination upon polymerization.

The amount of the positively chargeable charge control agent used other than the nigrosine dye is not particularly limited, provided that it falls within a range that does not inhibit the object of the present disclosure. Typically, the amount of the positively chargeable charge control agent used other than the nigrosine dye is preferably 1 to 500 parts by mass, and more preferably 10 to 300 parts by mass with respect to 100 parts by mass of the nigrosine dye.

Colorant

The magnetic toner for a single component developer of the present disclosure may contain a well-known blue dye or pigment as a colorant other than the nigrosine dye in order to adjust the hue of the toner to be more preferred, provided that it falls within a range that does not inhibit the object of the present disclosure.

The amount of the colorant used other than the nigrosine dye is not particularly limited, provided that it falls within a range that does not inhibit the object of the present disclosure. Typically, the amount is preferably 0.1 to 500 parts by mass, and more preferably 10 to 300 parts by mass with respect to 100 parts by mass of the nigrosine dye.

External Additive

The magnetic toner for a single component developer of the present disclosure may be treated on the surface thereof with an external additive as required. The type of the external additive is not particularly limited, provided that it falls within a range that does not inhibit the purpose of the present disclosure, and may be appropriately selected from those conventionally used for toners. Specific examples of suitable external additive include silica and metal oxides such as alumina, titanium oxide, magnesium oxide, zinc oxide, strontium titanate, and barium titanate. These external additives may be used in a combination of two or more. Also, these external additives may be used after subjecting to hydrophobilization with a hydrophobilizing agent such as an aminosilane coupling agent or a silicone oil. When a hydrophobilized external additive is used, lowering of the charged amount under high-temperature and high-humidity conditions is likely to be inhibited, and thus a toner that is superior in flowability is likely to be obtained.

The particle diameter of the external additive is not particularly limited, provided that it falls within a range that does not inhibit the purpose of the present disclosure, and typically is preferably 0.01 to 1.0 μm.

The volume-specific resistance value of the external additive can be adjusted by forming a coating layer consisting of tin oxide and antimony oxide on a surface of the external additive and changing a thickness of the coating layer or a ratio of tin oxide to antimony oxide.

The amount of the external additive used is not particularly limited, provided that it falls within a range that does not inhibit the purpose of the present disclosure. Typically, the amount of the external additive used is preferably 0.1 to 10 parts by mass, and more preferably 0.2 to 5 parts by mass with respect to 100 parts by mass of the toner particles before an external treatment.

Method for Producing Magnetic Toner for Single Component Developer

The magnetic toner for a single component developer is obtained by blending the binder resin with the nigrosine dyes and the magnetic powder, and as needed, optional components such as a release agent, a colorant other than the nigrosine dyes, and/or a charge control agent other than the nigrosine dyes, followed by melting and kneading, cooling, and pulverizing and classifying the product to adjust to have a desired particle diameter.

A process for preparing a toner by blending the binder resin with the nigrosine dyes, the magnetic powder, and as needed, optional components such as a release agent, a colorant other than the nigrosine dyes, and/or a charge control agent other than the nigrosine dyes is not particularly limited, provided that these components can be favorably dispersed in the binder resin. In a specific example of a suitable method for producing the toner, after the binder resin, the nigrosine dyes and the magnetic powder, and as needed, optional components such as a release agent, a colorant other than the nigrosine dyes, and/or a charge control agent other than the nigrosine dyes are mixed by a mixer or the like, the binder resin and the components to be blended with the binder resin are melted and kneaded by a kneading machine such as a monoaxial or biaxial extruder, followed by pulverizing and classifying the resulting kneaded material cooled. The average particle diameter of the toner is not particularly limited, provided that it falls within a range that does not inhibit the object of the present disclosure, and in general, the average particle diameter is preferably 5 to 10 μm.

Furthermore, a process for allowing the external additive to adhere on a surface of the toner particles is not particularly limited, and may be appropriately selected from among conventionally known methods. Specifically, treatment conditions are controlled such that particles of the external additive are not embedded into the surface of the toner, and the treatment with the external additive is carried out by a process of mixing the toner and the external additives using a mixer such as HENSCHEL mixer or NAUTOR mixer.

According to the magnetic toner for a single component developer of the present disclosure described in the foregoing, an image having a desired image density can be formed, and occurrence of layer disturbance of a toner layer formed on the surface of a developing roller of a developing device in low-temperature and low-humidity environments can be inhibited. Therefore, the magnetic toner for a single component developer of the present disclosure can be suitably used in a variety of image forming apparatuses equipped with a magnetic single component development system.

EXAMPLES

The present disclosure is explained more specifically with reference to Examples below. It is to be noted that the present disclosure is not in any way limited to the Examples.

A polyester resin used as a binder resin, and nigrosine dyes used in Examples and Comparative Examples were produced according to the method described in the following Preparation Examples 1 to 3.

Preparation Example 1

Preparation of Polyester Resin

A four-neck flask of 2-L volume equipped with a thermometer, a stainless steel stirrer, a nitrogen inlet glass tube, and a falling type condenser was used as a reaction vessel. Ethylene glycol in an amount of 54% by mole, 39% by mole of terephthalic acid, 7% by mole of trimellitic anhydride were charged into a reaction vessel such that the total mass of the monomer was 1.5 kg. The reaction vessel was placed on a mantle heater, and nitrogen gas was introduced from a nitrogen inlet glass tube into the reaction vessel to provide an inert atmosphere in the reaction vessel. Next, the internal temperature of the reaction vessel was elevated to 220° C. while stirring the monomer mixture, and then stirring was continued at the same temperature to allow for a polymerization reaction. A small amount of the resin in the reaction vessel was collected during the polymerization reaction to determine the acid value, and the polymerization reaction was stopped when the acid value reached 8 mg KOH/g. The content in the reaction vessel was taken into a stainless tray, and cooled to room temperature to obtain a polyester resin.

Preparation Example 2

Preparation of Nigrosine Dye (A)

After 500 g of aniline, 150 g of an aqueous hydrochloric acid solution having a concentration of 30% by mass, 12 g of dry ferrous chloride, and 12 g of iron powder were charged in a reaction vessel, the temperature of the mixture was elevated to 180° C. Subsequently, 150 g of nitrobenzene was added dropwise to the reaction mixture at the same temperature over 4 hrs. Thereafter, the temperature of the reaction mixture was elevated to 200° C., and a condensation reaction was allowed until nitrobenzene was almost absent. During the dropwise addition of nitrobenzene, and the condensation reaction, water, aniline and nitrobenzene were distilled off from the reaction vessel; however, after water was removed from the distillate of these, the distillate was placed back to the reaction vessel. After completing the reaction, sodium hydroxide having a concentration of 10% by mass in an equal amount to the reaction mixture was added to the reaction mixture, followed by stirring at 80° C. for 2 hrs and the reaction mixture was washed. Dietary salt was added to the mixture after washing, and then the mixture was transferred to a separating funnel followed by leaving to stand still. Liquid separation was carried out to give a dye phase and an aqueous sodium hydroxide solution phase, and the dye phase was recovered. After the dye phase was left to stand still, the deposited matter was removed by filtration. Subsequently, aniline and nitrobenzene were removed from the filtrate by vacuum distillation to give a nigrosine dye (A). The molecular weight of the nigrosine dye (A) thus obtained was measured on GPC (HLC-8220 (manufactured by Tosoh Corporation) to determine a weight average molecular weight (Mw) of 385.

According to the following method, the average diameter of the nigrosine dye dispersed in the polyester resin was determined to evaluate the solubility of the nigrosine dye (A) in the polyester resin. Smaller diameters of the nigrosine dye dispersed indicate higher solubility of the nigrosine dye in the polyester resin. The average diameter of the nigrosine dye (A) dispersed in the polyester resin is shown in Table 1. Method for Determining the Average Diameter of Nigrosine Dye Dispersed The nigrosine dye (A) in an amount of 3 parts by mass was added to 100 parts by mass of the polyester resin obtained in Preparation Example 1, and the mixture was stirred by a HENSCHEL mixer (FM-20B, manufactured by Nippon Coke & Engineering Co.) at 2,000 rpm for 4 min to permit mixing. Thereafter, the mixture thus obtained was melted and kneaded by a twin screw extruder (TEM-26SS, manufactured by Toshiba Machine Co., Ltd.) at a cylinder temperature of 100° C., a rotation frequency of 100 rpm, and a treatment rate of 50 g/min. As a sample for determining the average diameter of the nigrosine dye (A) dispersed, a thin piece of the melted and kneaded product having a thickness 200 nm was prepared with an ultramicrotome (EM UC6, manufactured by Leica). After the sample thus obtained was subjected to vapor deposition with carbon, the sample was observed with a transmission electron microscope (TEM) (JSM-7600F, manufactured by Jeol Ltd.) at a magnification of ×3,000 to ×30,000 to determine the average diameter of the nigrosine dye (A) dispersed in the polyester resin by an image analysis software (WINROOF, manufactured by Mitani Co.).

Preparation Example 3

Preparation of Nigrosine Dyes (B) to (G)

Nigrosine dyes (B) to (G) were prepared in a similar manner to nigrosine dye (A) except that the time period of addition of nitrobenzene was changed as shown in Table 1 below. The weight average molecular weight of the nigrosine dyes (B) to (G), and the average diameter of the nigrosine dyes (B) to (G) dispersed in the polyester resin were determined similarly to those of the nigrosine dye (A). The weight average molecular weight (Mw), and the average diameter of the nigrosine dye dispersed in the polyester resin of the nigrosine dye (A) and the nigrosine dyes (B) to (G) are shown in Table 1.

TABLE 1

| Nigrosine dye | Time period of addition of nitrobenzen | Weight average molecular weight(Mw) | Average diameter of dispersed nigrosine dye (in polyester resin) |
|---|---|---|---|
| A | 4 hours | 385 | 1 μm |
| B | 2 hours | 212 | undetermined (mutually solved) |
| C | 6 hours | 535 | 4 μm |
| D | 3 hours | 305 | 0.2 μm |
| E | 7 hours | 592 | 5 μm |
| F | 1 hour | 148 | undetermined (mutually solved) |
| G | 2.5 hours | 261 | 0.1 μm |

If the polyester resin obtained in Preparation Example 1 is used, even in the case in which only the polyester resin and the nigrosine dye that is immiscible with the polyester resin are kneaded, or even in the case in which the nigrosine dyes, the magnetic powder and the release agent are added to the polyester resin and kneading the mixture, dispersion in the polyester resin of the nigrosine dye that is immiscible with the polyester resin sufficiently proceeds by melting and kneading at 100° C. Therefore, the average diameter of the nigrosine dye dispersed determined by kneading only the polyester resin and the nigrosine dye that is immiscible with the polyester resin can be recognized to be identical to the average diameter of the nigrosine dyes dispersed in the toner.

Example 1

A polyester resin obtained in Preparation Example 1 in an amount of 100 parts by mass, 90 parts by mass of a magnetic powder (TN-15, manufactured by Mitsui Mining & Smelting Co., Ltd.), 3 parts by mass of the nigrosine dye (A), 3 parts by mass of the nigrosine dye (B), and 4 parts by mass of a release agent (carnauba wax, manufactured by Toa Kasei Co., Ltd.) were stirred by a HENSCHEL mixer (FM-20B, manufactured by Nippon Coke & Engineering Co.) at a rotation frequency of 200 rpm for 4 min to permit mixing. Thereafter, the mixture thus obtained was melted and kneaded by a twin screw extruder (TEM-26SS, manufactured by Toshiba Machine Co., Ltd.) at a cylinder temperature of 100° C., a rotation frequency of 100 rpm, and a treatment rate of 50 g/min. Thus resulting melted and kneaded product was charged in a jet mill (Micron Jet MJT-1, manufactured by Hosokawa Micron Corporation), and a pulverization treatment and a classification treatment were concomitantly carried out to obtain pulverized particles having an average particle diameter of 8 μm.

To 100 parts by mass of the resulting pulverized particles were added 0.6 parts by mass of silica fine particles (RA200, manufactured by Nippon Aerosil Co., Ltd.) and 0.8 parts by mass of titanium oxide (EC100, manufactured by Titan Kogyo, Ltd.), followed by mixing with a HENSCHEL mixer to obtain a toner.

With regard to the toner thus obtained, the image density of an image formed in an amount of toner of 0.5 mg/cm$^2$, the image density of an image formed by an actual machine, the fogging, and the layer disturbance were evaluated according to the following method. The results of the evaluation of the toner of Example 1 are shown in Table 2.

Evaluation of Image Density of Image Formed with the Toner in an Amount of 0.5 mg/cm$^2$ Evaluation was made using a modified machine of a page printer (FS-4020DN, manufactured by Kyocera Mita Co.). The toner in an amount of 150 g was packed in a developing device, and a solid image of 2.5 cm×2.5 cm was printed out on a paper to be recorded. The toner on the paper to be recorded prior to fixation was aspirated, and the mass (mg) of the toner per unit area (cm$^2$) was calculated. The developing bias was adjusted, and a developing bias to give an amount of toner per unit area on the paper to be recorded of 0.5 mg/cm$^2$ was determined. Subsequently, a solid image of 2.5 cm×2.5 cm was printed out with the determined developing bias to obtain a fixed image. The image density of the resulting solid image was measured using a reflective densitometer (TC-6DS, manufactured by Tokyo Denshoku CO., LTD.,). When the image density was no less than 1.25, the evaluation was made as "good", and when the image density was less than 1.25, the evaluation was made as "unsatisfactory".

Evaluation of Image Density of Image Formed by Actual Machine

A page printer (FS-4020DN, manufactured by Kyocera Mita Co.) was used as an actual machine for evaluation. The toner in an amount of 150 g was packed in a developing device, and a solid image of 2.5 cm×2.5 cm was printed out. The image density of the resulting solid image was measured using a reflective densitometer (TC-6DS, manufactured by Tokyo Denshoku CO., LTD.,). When the image density was no less than 1.3, the evaluation was made as "good", and when the image density was less than 1.3, the evaluation was made as "unsatisfactory".

Evaluation of Fogging by Actual Machine

A page printer (FS-4020DN, manufactured by Kyocera Mita Co.) was used as an actual machine for evaluation. The toner in an amount of 150 g was packed in a developing device, and a solid image of 2.5 cm×2.5 cm was printed out. The image density of an unprinted part of the paper to be recorded on which the solid image was formed, and the image density of an unused paper to be recorded were measured using a reflective densitometer (TC-6DS, manufactured by Tokyo Denshoku CO., LTD.,). The difference between the image density of an unprinted part of the paper to be recorded on which the solid image was formed, and the image density of an unused paper to be recorded was determined as a fogging density. When the fogging density was no greater than 0.01, the evaluation was made as "good", and when the fogging density exceeded 0.01, the evaluation was made as "unsatisfactory".

Evaluation of Layer Disturbance

A page printer (FS-4020DN, manufactured by Kyocera Mita Co.) and the toner were left to stand still for 12 hrs in a low-temperature and low-humidity environment of 10° C. and 20% RH. Next, 150 g of the toner was packed into a developing device of the page printer, and allowed to age for 10 min. After the aging, a clean sheet of the paper (a sheet of paper having no intended image thereon) was printed out, and the clean sheet thus printed out was observed to evaluate layer disturbance. When the layer disturbance occurred, the developing sleeve has a portion with a thicker toner layer formed thereon, and in this case, the fogging is printed on the clean sheet of paper at a cycle corresponding to the developing sleeve, due to the portion with the thicker toner layer.

Examples 2 to 4, and Comparative Examples 1 to 4

Toners were obtained in a similar manner to Example 1 except that the type and the amount of the nigrosine dyes were changed as shown in Table 2 or Table 3. It is to be noted that the amount of the nigrosine dyes used shown in Table 2 and Table 3 is parts by mass, with respect to 100 parts by mass of the polyester resin. Similarly to Example 1, evaluations were made on the image density of an image formed (amount of toner: 0.5 mg/cm$^2$), the image density of an image formed (evaluation by actual machine), the fogging (evaluation by actual machine), and the layer disturbance of the toners of Examples 2 to 4 and Comparative Examples 1 to 4. The results of evaluation of the tones of Examples 2 to 4 as well as Example 1 are shown in Table 2, and the results of evaluation of the toners of Comparative Examples 1 to 4 are shown in Table 3.

Comparative Example 5

An externally treated toner was obtained in a similar manner to Example 1 except that the nigrosine dyes were not used. The toners of Examples 1 to 4 and Comparative Examples 1 to 4 were positively chargeable toners since they contain nigrosine dyes, whereas the toner of Comparative Example 5 exhibited a negatively chargeable property due to an influence of charge polarity of the polyester resin since a nigrosine dye having a positively chargeable property was not included. Therefore, the toner of Comparative Example 5 failed to form an image by an image forming apparatus used in each evaluation of Example 1, and thus the image density of an image formed (amount of toner 0.5 mg/cm$^2$), the image density of an image formed (evaluation by actual machine), the fogging (evaluation by actual machine), and the layer disturbance were not evaluated.

TABLE 2

| | Example | | | |
|---|---|---|---|---|
| | 1 | 2 | 3 | 4 |
| Immiscible nigrosine dye | | | | |
| Type | A | C | D | A |
| Amount used (parts by mass) | 3 | 3 | 3 | 3 |
| Average diameter of dispersed nigrosine dye(μm) | 1 | 4 | 0.2 | 1 |
| Miscible nigrosine dye | | | | |
| Type | B | B | B | F |
| Amount used (parts by mass) | 3 | 3 | 3 | 3 |

TABLE 2-continued

| | Example | | | |
|---|---|---|---|---|
| | 1 | 2 | 3 | 4 |
| Image density (amount of toner: 0.5 mg/cm$^2$) | | | | |
| Density | 1.28 | 1.30 | 1.32 | 1.29 |
| Evaluation | good | good | good | good |
| Image density (evaluation by actual machine) | | | | |
| Density | 1.35 | 1.33 | 1.34 | 1.35 |
| Evaluation | good | good | good | good |
| Fogging (evaluation by actual machine) | | | | |
| Density | 0.000 | 0.000 | 0.000 | 0.000 |
| Evaluation | good | good | good | good |
| Layer disturbance | not found | not found | not found | not found |

TABLE 3

| | Comparative Example | | | | |
|---|---|---|---|---|---|
| | 1 | 2 | 3 | 4 | 5 |
| Immiscible nigrosine dye | | | | | |
| Type | A | — | E | G | — |
| Amount used (parts by mass) | 3 | — | 3 | 3 | — |
| Average diameter of dispersed nigrosine dye(μm) | 1 | — | 5 | 0.1 | — |
| Miscible nigrosine dye | | | | | |
| Type | — | B | B | B | — |
| Amount used (parts by mass) | — | 3 | 3 | 3 | — |
| Image density (amount of toner: 0.5 mg/cm$^2$) | | | | | |
| Density | 1.19 | 1.28 | 1.30 | 1.33 | — |
| Evaluation | unsatisfactory | good | good | Good | — |
| Image density (evaluation by actual machine) | | | | | |
| Density | 1.22 | 1.14 | 1.20 | 1.18 | — |
| Evaluation | unsatisfactory | unsatisfactory | unsatisfactory | unsatisfactory | — |
| Fogging (evaluation by actual machine) | | | | | |
| Density | 0.000 | 0.020 | 0.020 | 0.015 | — |
| Evaluation | good | Unsatisfactory | Unsatisfactory | Unsatisfactory | — |
| Layer disturbance | found | not found | not found | not found | — |

Examples 1 to 4 reveal that an image can be formed having a desired image density without generation of fogging, and without occurrence of layer disturbance in low-temperature and low-humidity environments, provided that the toner includes in a polyester resin a nigrosine dye that is immiscible with the polyester resin, and a nigrosine dye that is miscible with the polyester resin, and that the nigrosine dye that is immiscible with the polyester resin has an average diameter when dispersed in the polyester resin of 0.2 to 4 μm.

Comparative Example 1 reveals that formation of an image having a desired image density is difficult when a nigrosine dye that is miscible with the polyester resin is not used, even if a nigrosine dye that is immiscible with the polyester resin is used and the nigrosine dye that is immiscible with the polyester dispersed in the polyester resin has an average diameter of 0.2 to 4 μm. In addition, it is revealed that the toner of Comparative Example 1 fails to inhibit layer disturbance in low-temperature and low-humidity environments. It is believed that the layer disturbance results from occurrence of electrical aggregation of toner particles with one another because charge up caused at a positively chargeable site in which the nigrosine dye on the surface of the toner aggregated whereas the portion of the polyester resin on the surface of the toner is negatively charge.

Comparative Example 2 reveals that formation of an image having a desired image density by an actual machine is difficult when a nigrosine dye that is immiscible with the polyester resin is not used, even if a nigrosine dye that is miscible with the polyester resin is used, although an image having a desired image density is formed in the case in which the amount of toner is 0.5 mg/cm$^2$. In addition, it is revealed that the toner of Comparative Example 2 is likely to generate fogging. Since the toner of Comparative Example 2 does not include a nigrosine dye that is immiscible with the polyester resin, a positively chargeable site is not formed in which the nigrosine dye aggregates on the surface of the toner. It is therefore believed that there is a problem with the charging property of the toner of Comparative Example 2, and thus fogging is likely to be generated.

Comparative Example 3 reveals that formation of an image having a desired image density by an actual machine is difficult when a nigrosine dye that is immiscible with the polyester resin dispersed in the polyester resin has an average diameter of greater than 4 μm, even if a nigrosine dye that is immiscible with the polyester resin and a nigrosine dye that is miscible with the polyester resin are used, although an image having a desired image density is formed in the case in which the amount of toner is 0.5 mg/cm$^2$. In addition, it is revealed that the toner of Comparative Example 3 is likely to generate fogging. Since the toner of Comparative Example 3 has a great average diameter of the nigrosine dye that is immiscible with the polyester resin dispersed in the polyester resin, the number of positively chargeable sites on the surface of the toner is small. It is therefore believed that there is a problem with the charging property of the toner of Comparative Example 3, and thus fogging is likely to be generated.

Comparative Example 4 reveals that formation of an image having a desired image density by an actual machine is difficult when a nigrosine dye that is immiscible with the polyester resin dispersed in the polyester resin has an average diameter of less than 0.2 μm, even if a nigrosine dye that is immiscible with the polyester resin and a nigrosine dye that is miscible with the polyester resin are used, although an image having a desired image density is formed in the case in which the amount of toner is 0.5 mg/cm$^2$. In addition, it is revealed that the toner of Comparative Example 4 is likely to generate fogging. It is believed that the toner of Comparative Example 4 is less likely to be favorably charged, and fogging is likely to be generated since the toner of Comparative Example 4 has a too small average diameter of the nigrosine dye, that is immiscible with the polyester resin, dispersed in the polyester resin.

What is claimed is:

1. A magnetic toner for a single component developer, the magnetic toner comprising in a polyester resin at least a nigrosine dye that is immiscible with the polyester resin, a nigrosine dye that is miscible with the polyester resin, and a magnetic powder, the nigrosine dye that is immiscible with the polyester resin having an average diameter of 0.2 to 4 μm when dispersed in the polyester resin.

2. The magnetic toner for a single component developer according to claim 1, wherein the nigrosine dye that is immiscible with the polyester resin has a weight average molecular weight of 305 to 535 as determined by gel permeation chromatography, and the nigrosine dye that is miscible with the polyester resin has a weight average molecular weight of no greater than 212 as determined by gel permeation chromatography.

3. The magnetic toner for a single component developer according to claim 1, wherein the content of the nigrosine dye that is immiscible with the polyester resin is 0.1 to 10 parts by mass with respect to 100 parts by mass of the polyester resin.

4. The magnetic toner for a single component developer according to claim 3, wherein the content of the nigrosine dye that is miscible with the polyester resin is 0.1 to 5 parts by mass with respect to 100 parts by mass of the polyester resin.

* * * * *